US005993334A

United States Patent [19]

McNamara

[11] Patent Number: 5,993,334

[45] Date of Patent: Nov. 30, 1999

[54] PRACTICE BACKDROP AND TARGET

[76] Inventor: Patrick E McNamara, 92 Doover La., Mahtomedi, Minn. 55115

[21] Appl. No.: 09/036,769

[22] Filed: Mar. 9, 1998

[51] Int. Cl.[6] ..... A63B 69/00

[52] U.S. Cl. ..... 473/446

[58] Field of Search ..... 473/446

[56] References Cited

U.S. PATENT DOCUMENTS

| | | | |
|---|---|---|---|
| 3,195,898 | 7/1965 | Respini . | |
| 3,672,672 | 6/1972 | Rubin . | |
| 3,840,228 | 10/1974 | Greaney . | |
| 4,153,246 | 5/1979 | Byrne . | |
| 4,344,621 | 8/1982 | Baker | 473/446 |
| 4,842,284 | 6/1989 | Rushing et al. . | |
| 4,969,651 | 11/1990 | Comartin . | |
| 5,166,056 | 11/1992 | Schmutte . | |
| 5,269,527 | 12/1993 | Noval . | |
| 5,549,302 | 8/1996 | Lapsker | 473/446 X |
| 5,664,784 | 9/1997 | Redlich | 473/446 X |

OTHER PUBLICATIONS

Shotmaker™ 3–Way Hockey Shooting System by Shotmaker, Baudette, Minn. p. 34 of *Let's Play Hockey*, Jan. 19, 1995.

Tutor Jr. or Shooter Tutor by Ocean Hockey Supply, Colorado Springs, Colorado, Nov. 1997.

*Primary Examiner*—William H. Grieb

*Attorney, Agent, or Firm*—James V Harmon

[57] ABSTRACT

A practice backdrop for hockey and other sports includes a flexible backdrop sheet, e.g. vinyl plastic impregnated cloth. Connectors support the backdrop sheet from its upper edge. An impact-dampening weight is connected to the backdrop sheet near its lower edge to help the backdrop sheet absorb the impact of a hockey puck or ball which strikes it. A removable and replaceable target sheet that has a frontal area which is smaller than the backdrop and can be formed from cloth is overlaid against the front surface of the backdrop to serve as an object for a player to shoot at and to help cushion the impact of shots fired at the backdrop. Lifting cords elevate and simultaneously fold both the backdrop and target into contiguous horizontally extending accordion folds in which horizontal folds of the target are lapped between horizontal folds of the backdrop material.

20 Claims, 4 Drawing Sheets

10
12
18
30
32
33
34
36
40
50
52
60
62
64
68
69

PRACTICE BACKDROP AND TARGET

FIELD OF THE INVENTION

This invention relates to sporting equipment and more specifically to a suspended practice backdrop and target formed from flexible material that is suited for use in practicing hockey shots.

BACKGROUND OF THE INVENTION

Practice targets have been used previously for practicing hockey shots, but the targets have been connected to a hockey goal. They therefore require the expense of a goal. They are also limited in where they can be used and are not very effective in protecting bystanders and property from shots that go wild, i e., beyond the edges of the target. A puck will strike a target with considerable force. Prior targets do not provide optimum cushioning of the impact of the puck against the target.

One general objective of the invention is therefore to provide a target that will enable a hockey player to practice shooting the puck without the use of a goal in a variety of locations, including residential parking garages, basements, schools and recreational arenas with little chance of damaging the wall of the building or items stored on shelves within the building. Such a product would enable a player to practice in a building, e.g. either in a closed garage or with the garage door open and standing just outside the garage door. Targets that were available prior to the present invention were unable to protect the building or items within the building from shots that go wild while at the same time providing a target area with the impact absorption capacity to allow the puck to fall harmlessly to the floor after the target had been hit.

In view of the shortcomings of the prior art, it is thus one object of the invention to provide a backdrop and target for sports practice that provides protection on either side and above the target area.

Another object of the invention is to provide a target device that has a vertically suspended flexible sheet of material for arresting the motion of a puck or ball used in sports activities with a layer of additional material overlaid adjacent to the sheet for cushioning the impact of shots that are fired at the target device.

Yet another object of the invention is to provide a sturdy backdrop that will protect objects from a flying puck, can be stored in a compact bundle, and can be collapsed and moved to an out-of-the-way position when not in use.

These and other more detailed and specific objects of the present invention will be better understood by reference to the following figures and detailed description which illustrate by way of example but a few of the various forms of the invention within the scope of the appended claims.

SUMMARY OF THE INVENTION

The invention provides a practice backdrop for hockey and other sports comprising a flexible backdrop sheet having an upper edge and a lower edge. At least one connector is provided for the backdrop to support the backdrop sheet from its upper edge. An impact-dampening weight is connected to the backdrop in the proximity of its bottom edge to enable the backdrop to arrest the impact of a hockey puck or ball which strikes it. In one preferred form of the invention, a removable and replaceable target having a frontal area that is smaller than the backdrop and formed from a flexible sheet of material is overlaid against the front surface of the backdrop to serve as an object for a player to shoot at and to help cushion the impact of shots fired at the backdrop. Provision is also preferably made for raising and simultaneously folding the backdrop and target into contiguous horizontally extending accordion folds in which horizontal folds of the target are lapped between horizontal folds of the backdrop material.

THE FIGURES

DETAILED DESCRIPTION OF THE INVENTION

Figure 1:
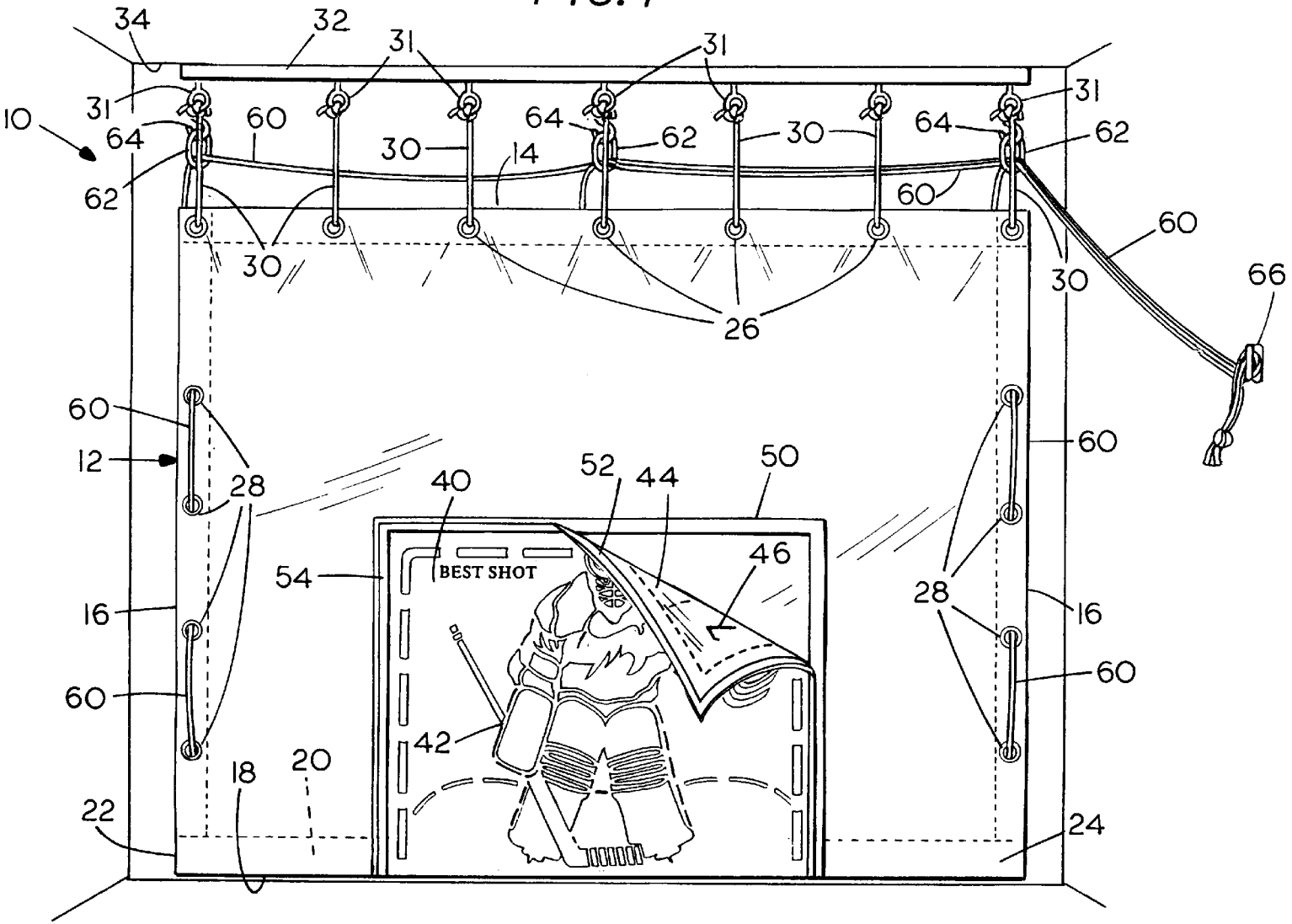
FIG. 1 is a front elevational view of one preferred form of the invention.
Figure 2:
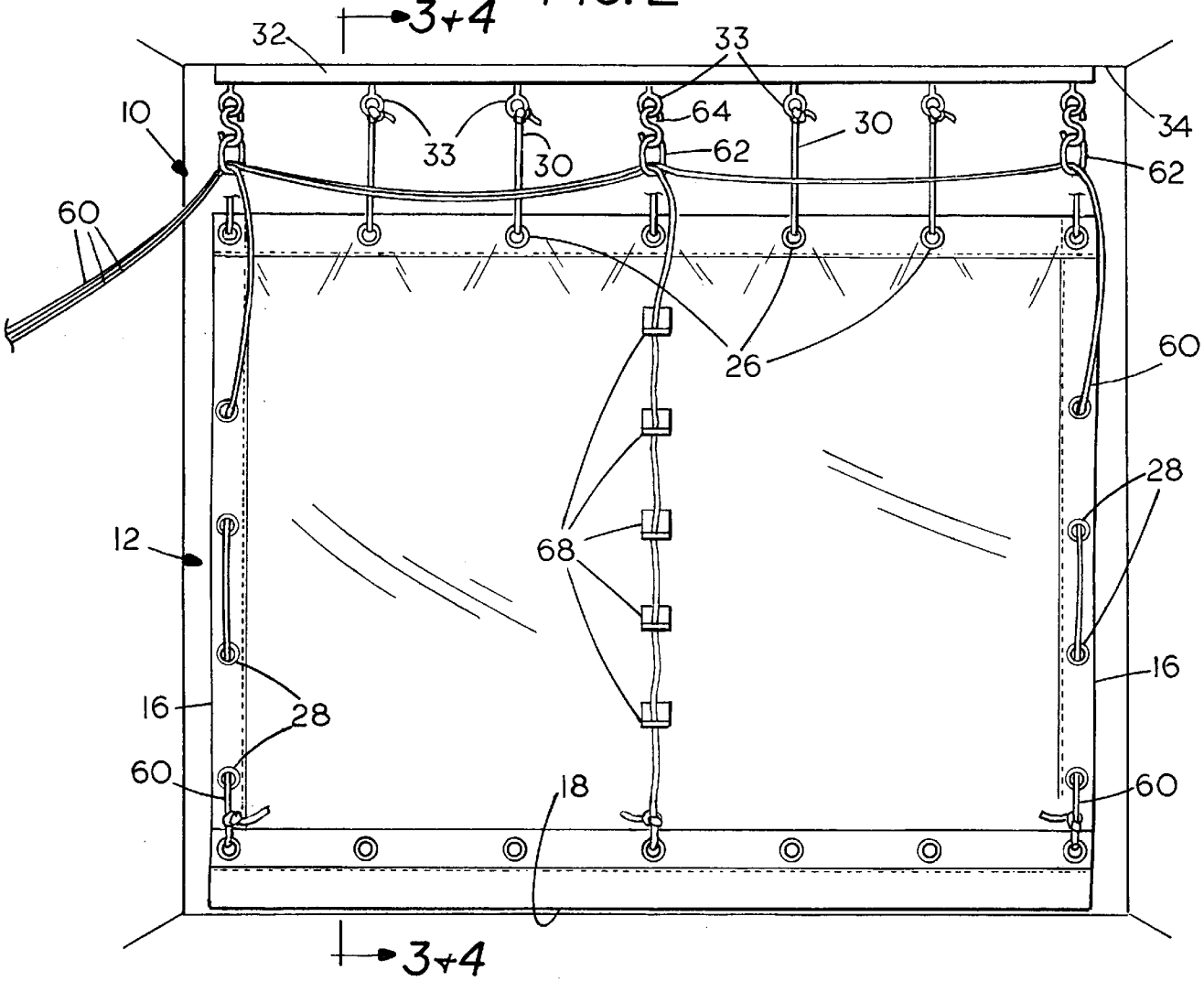
FIG. 2 is a rear elevational view of FIG. 1.

Shown in FIG. 1 is a backdrop apparatus 10 in accordance with the invention which in this case is particularly adapted for hockey but is also suitable for other sports such as golf, baseball, soccer, tennis and the like. The backdrop apparatus 10 includes a backdrop 12 that is formed from flexible sheet material such as cloth or plastic-impregnated cloth, e.g. a 7.5 foot×9.5 foot sheet of 18-ounce vinyl plastic impregnated cloth, having top, side and bottom edges 14, 16 and 18, respectively, each with an adjacent sewn hem as shown. The cloth can be, for example, cotton canvas, polyester, nylon, rayon, Dacron®, Kevlar® or other synthetic resin. The hem adjacent the bottom edge 18 encloses a horizontally disposed elongated pocket 20 which is open at each of its ends 22 and 24. Within the hem adjacent the top edge 14 are provided a plurality of metal grommets 26. Similar grommets 28 are provided in each of the hems along the side edges 16, and grommets 29 are provided in the bottom hem.

Figure 10:
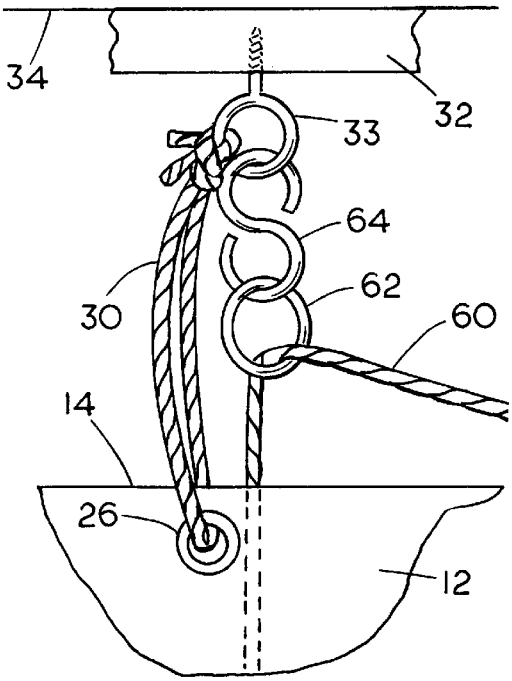
FIG. 10 is a front elevational view of the top portion of the backdrop apparatus to show the support structure.

In accordance with the invention, the backdrop 12 is suspended solely from its upper edge 14 by means of supporting connectors, in this case short lengths of rope or cord 30 extending between a fixed overhead structure, typically a board 32 attached to the ceiling 34 inside an automobile garage or other building. The ropes 30 can be connected between an eye-hook 33 that is screwed into the board 32 and one of the grommets 26 as shown in FIG. 10. It is convenient to suspend the backdrop apparatus 10 from the ceiling 34 at a distance of about 1 to 20 inches such that the bottom edge 18 is spaced about one-half inch above the floor or ground. The invention will therefore fit various ceiling heights. Inside the pocket 20 adjacent the bottom edge 18 is suspended an impact-absorbing weight such as a wooden two-by-four 36 or a one-inch diameter iron pipe for exerting downward tension on the backdrop structure. The downward tension exerted by the weight 36 helps to arrest the impact of a flying puck or ball. The size of the backdrop sheet 12 can be as large as desired, but I have obtained excellent results with a backdrop sheet measuring 7.5 feet high by 9.5 feet wide. For a larger size room or garage, a larger backdrop can be used. Because of the relatively large size of the backdrop sheet 12 compared to the size of an ordinary hockey goal, practically the entire end of a room or the wall of a garage will be protected even if the shot goes wild and does not hit the desired target area.

Figure 8:
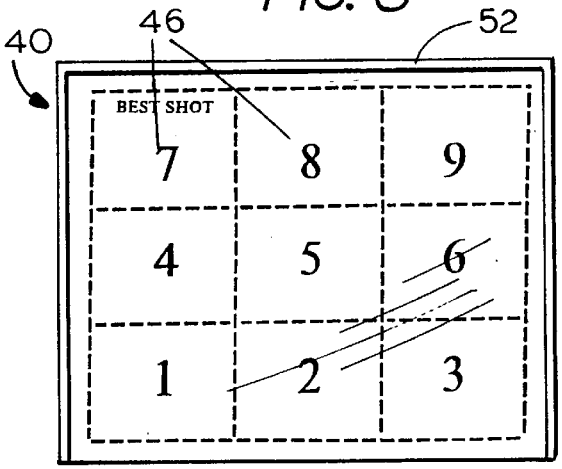
FIG. 8 is a rear elevational view of the removable target.
Figure 9:
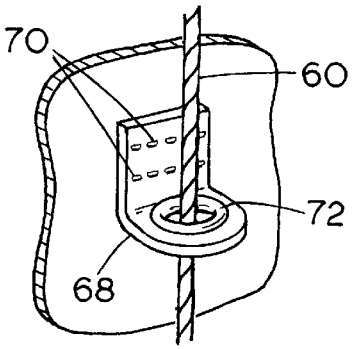
FIG. 9 is a perspective view of a grommet used for guiding one of the lifting cords.

Near the center of the backdrop 12 and adjacent its bottom edge 18 is overlaid a removable, reusable and replaceable target comprising a rectangular flexible sheet of material 40, e.g. 18-ounce vinyl plastic impregnated cloth, having a front surface carrying printed indicia such as the image of a hockey player 42, and a rear surface 44 carrying other printed indicia such as target numbers 46 (FIGS. 1 and 8). The target 40 is removably and replaceably secured to the backdrop sheet 12 by means of a fastener that is capable of being disconnected when desired, such as a hook-and-loop fastener, e.g. Velcro® fasteners comprising hook or loop strips 50 secured to the backdrop 12 as well as complementary strips 52 on the back surface 44 and 54 on the front surface of the target sheet 40. Thus, whenever desired, the target sheet 40 can be completely removed then turned around and mounted in the reverse position so that the back surface 44 faces the player as shown in FIG. 8. In this way the target 40 provides different printed indicia for different purposes so as to increase the versatility of the invention by allowing the player to use the backdrop apparatus 10 for different purposes or for different sports simply by removing and reversing the target 40, i.e. by mounting the target 40 with the reverse side 44 facing the player. The target 40, besides serving as an object to shoot at, helps to cushion the impact of shots fired at the backdrop and increases the life expectancy of the invention. In the meantime, the backdrop sheet 12 is large enough to protect an entire wall, for example, the back wall of a garage and any articles that may be stored on shelves or behind the backdrop.

The front surface of the target 40 as shown in FIGS. I and 7 in this case carries the image of a hockey goalie 42 for the player to shoot at. On the back surface, shown at the right in FIG. 1 and in FIG. 8, is provided different printed indicia such as numbered squares to be used in scoring targeted shots. Portions of the backdrop 12 can also be imprinted with indicia such as targets and the like, if desired. Reversing the target 40 provides additional versatility and adds interest to the practice sessions. The invention can be used with other printed indicia for various sports including golf, tennis, baseball, soccer and the like. The backdrop apparatus 10 as shown in FIGS. 1–4 is illustrated in the deployed position ready for use with its lower edge 18 spaced a small distance, e.g., about one-half inch, from the floor.

Figures 3, 4, 5, 6:
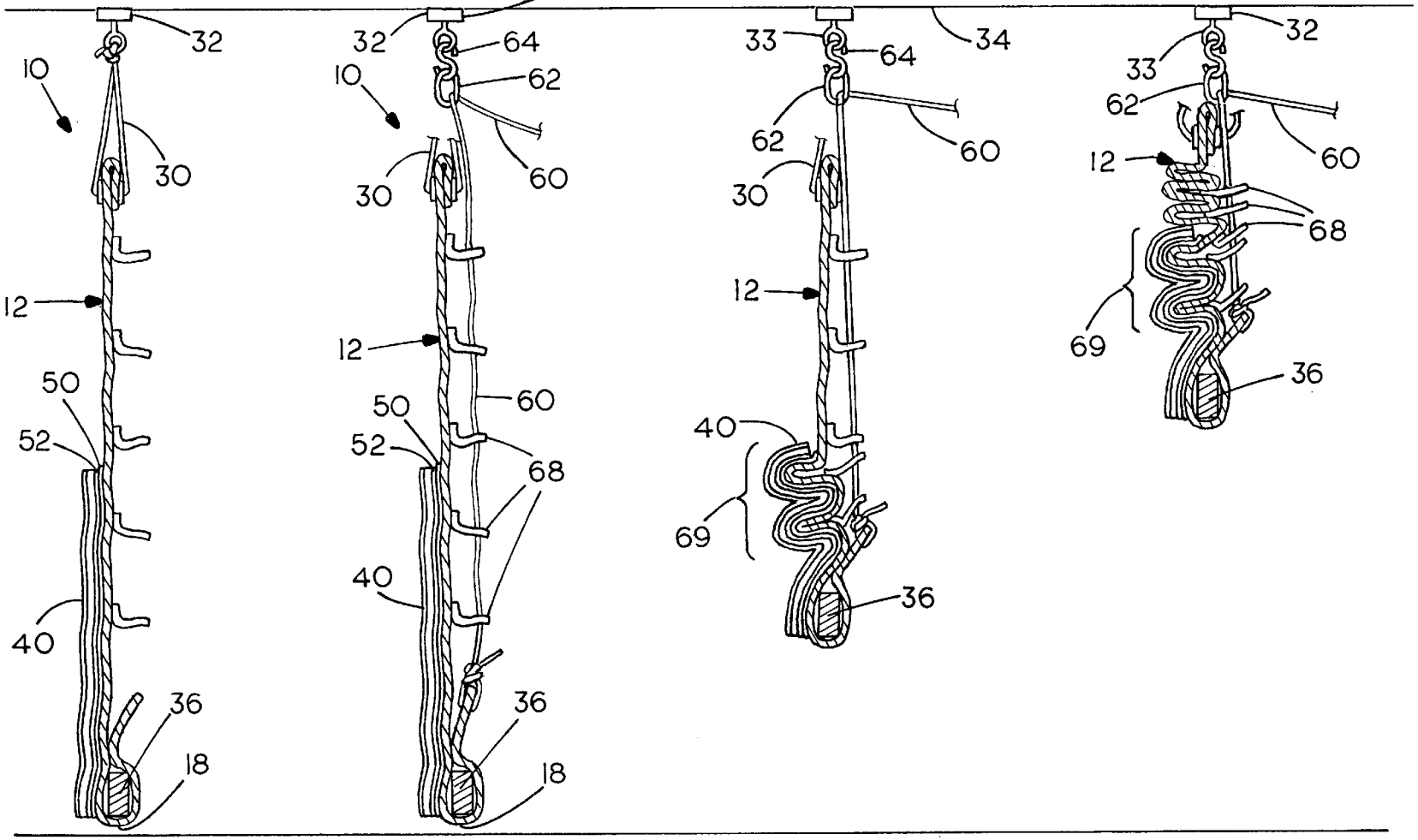
FIG. 3 is a vertical sectional view taken on line 3—3 of FIG. 2 with the lifting cord removed for clarity of illustration.
FIG. 4 is a vertical sectional view taken on line 4—4 of FIG. 2 with the lifting cord in place.
FIG. 5 is a vertical sectional view similar to FIG. 4 with the backdrop partly elevated.
FIG. 6 is a view similar to FIG. 5 with the backdrop raised further toward the ceiling.
Figure 7:
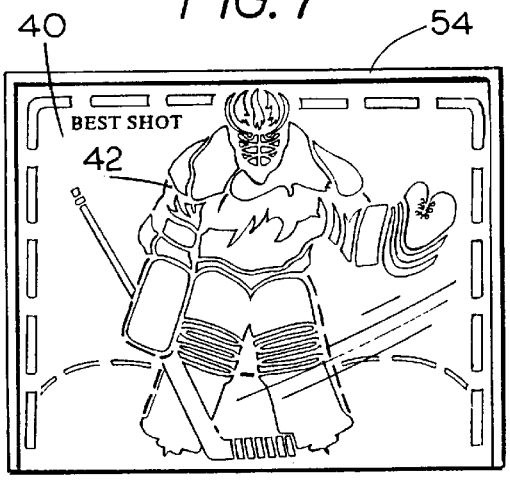
FIG. 7 is a front elevational view of the removable target.

Refer now to FIGS. 3 and 4. It can be seen that when the hockey puck or ball strikes the target 40 it will deflect the target 40 and backdrop 12 toward the right as seen in FIGS. 3 and 4. The force of the impact will be exerted through the target 40 and backdrop 12 down to the weight 36 which will be raised slightly as a result of the impact, thereby helping to cushion the force of the impact and effectively arresting the motion of the puck or ball without damage and little wear to the backdrop or target.

The backdrop 12 and target 40 can be elevated to an out-of-the-way position by means of lifting cords 60. In this case, three cords 60 are provided. All three of the lifting cords 60 pass through suitable supports such as two-inch steel rings 62 each connected to one of the eye-hooks 33 by means of an S-hook 64 or other suitable fastener (FIG. 10). The free ends of all of the cords 60 at the right in FIG. 1 are secured to a fixed object such as a wall cleat 66 which is fastened to the wall of the room. The outer two cords 60, after passing through the steel rings 62, extend downwardly and are entrained through the vertically arranged grommets 28 adjacent each of the side edges 16. The center cord 60, after passing through a centrally located steel ring 62, extends downwardly and is entrained through a series of rearwardly extending vertically disposed and aligned flaps 68 fastened to the center line of the backdrop sheet 12 by sewing at 70. Each of the flaps 68 includes a grommet 72 surrounding the cord 60. The lower end of each of the cords 60 is secured to the backdrop 12 near its bottom edge 18.

FIGS. 5 and 6 show successive positions as the backdrop 12 and target 40 are raised to an out-of-the-way overhead location so that the room or other space can be used for a different purpose, e.g. the parking of a car. After the backdrop apparatus 10 has been elevated all the way by pulling on the cords 60, generally as shown in FIG. 6, the cords 60 are fastened to the wall cleats 66 so as to suspend the backdrop 12 and target 40 in the raised position (FIG. 6) until the next time it is to be used. The term "cord" herein is used broadly to include rope, cable, chain and other elongated, flexible tension-imparting articles. It can be seen in FIGS. 5 and 6 that when the lifting cord 60 is pulled, the backdrop 12 and target 40 which lie adjacent one another are both folded simultaneously into contiguous horizontally extending accordion folds including horizontal folds of the target 40 lapped between horizontal folds of the backdrop 12 as shown at 69 in FIGS. 5 and 6. The target 40 and backdrop 12, owing to their flexibility, are both capable of bending or folding together to form the horizontally disposed stack of accordion folds shown at 69 with the folds in the target 40 interposed between the folds in the backdrop 12.

It will be seen that the backdrop 12 is supported during use solely from its upper edge by means of the connectors 30 with the impact-dampening weight 36 attached to the backdrop proximate its bottom edge. This stretches and flattens the backdrop 12 and target 40 as well as helping to cushion shots due to the impact-dampening effect of the weight 36. The target 40 has a frontal area, e.g. 4'×5', that is smaller than the area of the backdrop 12. The target 40 thus serves as an object for the player to shoot at as well as to help cushion the impact of the shot fired at the backdrop 12, thereby extending the life of the backdrop 12.

Figure 11:
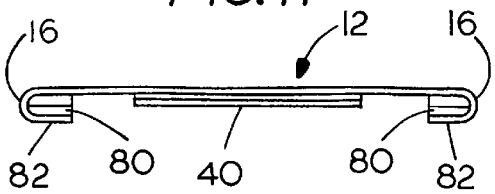
FIG. 11 is a transverse horizontal sectional view of a modified form of the invention.

Refer now to FIG. 11 which illustrates an alternate form of the invention in which the same numerals refer to corresponding parts already described. In this case the backdrop 12 is provided with side flaps 82 that are folded forwardly and centrally along each side edge 16 to provide two vertically disposed centrally opening pockets 80. The side flaps 82 along each edge define the centrally opening pockets 80 and are attached, e.g by sewing, at their top and bottom edges to the top and bottom hems at 14 and 18 to help the pockets 80 hold their shape and keep the side flaps in place. The centrally facing pockets 80 along each vertical side edge are helpful in catching the puck in the event it is deflected toward the side and thus provide additional help in arresting the motion of the puck or ball, particularly in the case of a wild shot that could otherwise be deflected to one side so as to damage something in the building.

To use the invention, the connectors such as the short lengths of rope 30 are secured between suitable fasteners such as the eye-hooks 33 or other suitable fixed structure and the grommets 26 in the top hem of the backdrop 12, their length being adjusted to support the lower edge 18 of the backdrop 12 either at or slightly above the floor or ground. The steel rings 62 are secured in place by using the S-hooks 64 to connect the rings 62 and entrained through the grommets 70 or 28, as the case may be, and fastened to the backdrop 12 by its bottom edge. The target 40 is then attached to the backdrop 12 by means of Velcro® strips 50, 52 or 54. The invention will then be deployed for use as shown in FIGS. 1–4. When the cords 60 are pulled, the target 40 and backdrop 12 will be raised out of the way so that the car will then fin in the garage.

Many variations of the present invention within the scope of the appended claims will be apparent to those skilled in the art once the principles described herein are understood.

What is claimed is:

1. A backdrop apparatus comprising, at least one sheet of flexible material including a backdrop sheet and a target, the target and the backdrop sheet being together with the target exposed on a front surface of the backdrop sheet, a support for holding the backdrop apparatus in an upright position, a lifting cord having a portion at a bottom portion of the backdrop apparatus and extending upwardly therefrom for raising and lowering the backdrop, each such sheet having sufficient flexibility to be capable of being collapsed and stored in a compact bundle when raised by the lifting cord to an out-of-the-way position when not in use.

2. The practice backdrop of claim 1 wherein a weight comprising an elongated article connected to the bottom edge of the backdrop and extends horizontally, said weight being suspended above the ground by means of the backdrop so as to exert a downward force on the backdrop for stretching the backdrop and for enabling the lower edge of the backdrop to yield upwardly against the downward force of the weight when struck by a puck or ball.

3. The article of claim 2 wherein the weight is a wooden two-by-four.

4. The article of claim 2 wherein the weight is an iron pipe.

5. The backdrop apparatus of claim 1 wherein the target has a front surface and a rear surface, graphic indicia is imprinted upon at least one of the surfaces of the target, and the target is secured to the backdrop by a hook-and-loop fastener.

6. The backdrop apparatus of claim 1 wherein the backdrop and target are formed from plastic-impregnated cloth.

7. The backdrop apparatus of claim 6 wherein the cloth is a synthetic resinous cloth.

8. The backdrop apparatus of claim 1 wherein the backdrop is supported by a plurality of laterally distributed, vertically extending connecting elements that extend between the top edge of the backdrop and an overhead structure.

9. The article of claim 8 wherein the connecting elements are cords connected at one end to the overhead structure and at the other end to a top edge of the backdrop.

10. The backdrop apparatus of claim 1 wherein the backdrop sheet is supported from an upper edge thereof and is suspended when in use with a lower edge proximate the ground or the floor of a building.

11. A backdrop apparatus comprising, a pair of sheets of flexible material including a backdrop sheet and a target sheet, said sheets being connected together with one sheet overlaid against the other, a support for holding the sheets in an upright position, lifting cords connected to the backdrop apparatus for raising and lowering the backdrop and forming accordion folds therein, both of said sheets having sufficient flexibility to be folded simultaneously when the backdrop is raised by lifting the cords into contiguous horizontally extending accordion folds that include folds of the target sheet that are lapped between folds of the backdrop sheet.

12. The backdrop apparatus of claim 11 wherein both of the sheets are formed from plastic-impregnated cloth and the target is imprinted with graphic indicia.

13. The backdrop apparatus of claim 12 wherein the cloth is synthetic resinous cloth.

14. The backdrop apparatus of claim 11 wherein one sheet is a target sheet that is secured to the other sheet by releasable fasteners for enabling the target sheet to be removed and replaced.

15. The apparatus of claim 14 wherein the target sheet is reversibly and removably connectable to the other sheet, the target sheet includes a front surface and a rear surface whereby the target sheet can be connected to the other sheet with either the front surface or the rear surface thereof exposed to view.

16. The apparatus of claim 14 wherein the target sheet is supported solely from the other sheet, the other sheet is a backdrop sheet supported from an upper edge thereof and is suspended with a lower edge thereof proximate the ground or the floor of a building structure.

17. The apparatus of claim 16 wherein the lower edge of the backdrop is weighted by having a weight connected thereto for exerting downward tension on the lower edge of the backdrop sheet.

18. The apparatus of claim 17 wherein the weight is a wooden two-by-four.

19. The apparatus of claim 17 wherein the weight is an iron pipe suspended in a hem at the lower edge of the backdrop.

20. A practice backdrop for hockey and other sports comprising, a flexible backdrop sheet having an upper edge and a lower edge, a support for the backdrop to suspend the backdrop sheet from the upper edge thereof, an impact-dampening weight connected to the backdrop proximate the bottom edge thereof for assisting in arresting the shock of a hockey puck or ball that strikes the backdrop, and the backdrop includes vertically extending, centrally opening side pockets disposed along vertically extending side edges of the backdrop and including a flap of flexible sheet material facing a front surface of the backdrop and extending centrally from each side edge thereof to define said pockets at each side edge of the backdrop for catching shots that are deflected laterally from the backdrop.

* * * * *